US006759639B2

(12) United States Patent
Shon et al.

(10) Patent No.: US 6,759,639 B2
(45) Date of Patent: Jul. 6, 2004

(54) MAGNETRON FOR MICROWAVE OVENS

(75) Inventors: Jong-Chull Shon, Suwon (KR); Boris V. Rayskiy, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/303,009

(22) Filed: Nov. 25, 2002

(65) Prior Publication Data

US 2004/0016753 A1 Jan. 29, 2004

(30) Foreign Application Priority Data

Jul. 27, 2002 (KR) ..... 10-2002-0044453

(51) Int. Cl.[7] ..... H05B 6/72
(52) U.S. Cl. ..... 219/761; 219/702; 315/39.51
(58) Field of Search ..... 315/39.51, 39.65, 315/39.67, 39.69, 39.71; 219/702, 761

(56) References Cited

U.S. PATENT DOCUMENTS 5,090,613 A * 2/1992 Lee ..... 228/254

OTHER PUBLICATIONS

Patent Abstract of Japan Publication No. 2000–11904, publication date Jan. 14, 2000.
Patent Abstract of Korean Publication No. 1020000016904, publication date Mar. 25, 2000.

* cited by examiner

*Primary Examiner*—Thor Campbell
(74) *Attorney, Agent, or Firm*—Staas & Halsey LLP

(57) ABSTRACT

A magnetron for use in, for example, microwave ovens, includes a positive polar cylinder, a plurality of vanes, and large-diameter and small-diameter strip rings. The vanes constitute a positive polar section, along with the positive polar cylinder. The large-diameter and small-diameter strip rings are disposed on an upper portion and a lower portion of the vanes, respectively, to alternatively and electrically connect the vanes to one another. The inside and outside diameters of the large-diameter strip ring are in a range of 17.1 mm to 18.01 mm and 18.6 mm to 19.6 mm, respectively. The inside and outside diameters of the small-diameter strip ring are in a range of 13.4 mm to 14.4 mm and 14.9 mm to 15.9 mm, respectively. The height of the large-diameter and small-diameter strip rings is in a range of 1.50 mm to 1.60 mm. The distance between the large-diameter strip ring and the small-diameter strip ring is maintained in an error range of 2.20 mm.

23 Claims, 4 Drawing Sheets

103
114
108
106
112
101
117
104
102
107
116
105
115
109
113
118
110
111

MAGNETRON FOR MICROWAVE OVENS

CROSS-REFERENCE TO RELATED APPLICATIONS

This application claims the benefit of Korean Application No. 2002-44453, filed Jul. 27, 2002, in the Korean Intellectual Property Office, the disclosure of which is incorporated herein by reference.

BACKGROUND OF THE INVENTION

1. Field of the Invention

The present invention relates to a magnetron for microwave ovens, and more particularly, to strip rings of a magnetron having predetermined geometrical configurations to increase the efficiency of the magnetron.

2. Description of the Related Art

Generally, a magnetron includes an anode, and a cathode which discharges thermions. The thermions are spirally moved by an electromagnetic force to reach the anode. At this time, a spinning electron pole is generated around the cathode by the thermions and an induced current is generated in an oscillation circuit of the anode, so as to continuously stimulate an oscillation. The oscillation frequency of the magnetron is generally determined by the oscillation circuit, and has high efficiency and high output power.

The above-described magnetron is widely used as parts of home appliances, including a microwave oven, as well as parts of industrial applications, such as a high-frequency heating apparatus, a particle accelerator and a radar system.

FIGS. 1 to 3 show the construction of a conventional magnetron.

As shown in FIG. 1, the magnetron includes a positive polar cylinder 101 made of, for example, an oxygen free copper pipe, and a plurality of vanes 102 which are disposed in the positive polar cylinder 101 and constitute a positive polar section along with the positive polar cylinder 101. The vanes 102 are radially arranged at regular intervals to form a cavity resonator. An antenna 103 is connected to one of the vanes 102 to induce harmonics to the outside.

Referring to FIG. 2, a large-diameter strip ring 104 and a small-diameter strip ring 105 are disposed on upper and lower portions of the vanes 102, respectively, to alternately and electrically connect the vanes 102 so that the vanes 102 alternately have the same electric potential. Rectangular vane channels 202 are formed in the vanes 102, respectively, to allow the strip rings 104 and 105 to alternately and electrically connect the vanes 102, and cause each opposite pair of vanes 102 to be disposed in an upside-down manner.

According to the above-described construction, each opposite pair of vanes 102 and the positive polar cylinder 101 constitute a certain inductive-capacitive (LC) resonant circuit.

Additionally, a filament 106 in a form of a coil spring is disposed in an axial center portion of the positive polar cylinder 101, and an activating space 107 is provided between radial inside ends of the vanes 102 and the filament 106. A top shield 108 and a bottom shield 109 are attached to a top and bottom of the filament 106, respectively. A center lead 110 is fixedly welded to a bottom of the top shield 108 while passing through a through hole of the bottom shield 109 and the filament 106. A side lead 111 is welded to a bottom of the bottom shield 109. The center lead 110 and the side lead 111 are connected to terminals of an external power source (not shown), so as to form a closed circuit in the magnetron.

An upper permanent magnet 112 and a lower permanent magnet 113 are provided to apply a magnetic field to the activating space 107 with the opposite magnetic poles of the upper and lower permanent magnets 112 and 113 facing each other. An upper pole piece 117 and a lower pole piece 118 are provided to induce rotating magnetic flux generated by the permanent magnets 112 and 113 into the activating space 107.

The above-described elements are enclosed in an upper yoke 114 and a lower yoke 115. A reference numeral 116 designates cooling fins which connect the positive polar cylinder 101 to the lower yoke 115 and radiate heat generated in the positive polar cylinder 101 to the outside through the lower yoke 115.

Referring to FIG. 3, with reference to FIG. 1, as power is applied to the filament 106 from an external power source (not shown), the filament 106 is heated by an operational current supplied to the filament 106, and thermions are emitted from the filament 106. A thermion group 301 is produced in the activating space 107 by the emitted thermions. The thermion group 301 alternately imparts a potential difference to each neighboring pair of vanes 102 while being in contact with front ends of the vanes 102, being rotated by the influence of a magnetic field formed in the activating space 107 and being moved from one state "i" to the other state "f." Accordingly, harmonics corresponding to a rotation speed of the thermion group 301 are generated by the oscillation of the LC resonant circuit formed by the vanes 102 and the positive polar cylinder 101, and are transmitted to the outside through the antenna 103.

Generally, a frequency is calculated by the equation:

$$f = \frac{1}{2\pi\sqrt{LC}}$$

where L is an inductance and C is a capacitance. The values of the variables of the equation are determined by the geometrical configurations of circuit elements. Accordingly, the configurations of the vanes 102 constituting a part of the LC resonant circuit are principal factors that determine the frequency of the harmonics.

An oscillation frequency of a magnetron for microwave ovens is fixed to a frequency of 2,450 MHz. Since the magnetron for the microwave ovens has a fixed frequency, the magnetron has to be precisely adjusted to the frequency of 2,450 MHz during a production thereof. Although the magnetron has a fixed frequency, the oscillation frequency of the magnetron varies in a range from about ±10 to about ±15 MHz around a central frequency by the variation of a load under actual operational conditions.

Although, in practice, the magnetron generates a variety of frequencies, a single prominent frequency is specified by a frequency measuring process, and referred to as the oscillation frequency of the magnetron. To set the oscillation frequency of the magnetron in the positive polar cylinder 101, the large-diameter strip ring 104 and the small-diameter strip ring 105, as well as the vanes 102, play principal roles. That is, electric phases of the large-diameter and small-diameter strip rings 104 and 105, which alternately connect the alternately arranged vanes 102 to allow each set of vanes 102 to have the same potential, are changed as electric phases of the vanes 102 are changed. The large- and small-diameter strip rings 104 and 105 oscillate while experiencing the alternate change of the electric phases. A certain amount of electrostatic capacity exists between the large-diameter and small-diameter strip rings 104 and 105 facing each other, and a certain electric oscillation is generated therebetween, generating an unwanted frequency called a parasitic frequency.

Accordingly, a minute frequency is set using the large- and small-diameter strip rings 104 and 105. The shapes and sizes of the large- and small-diameter strip rings 104 and 105, which are fixedly mounted in the magnetron, determine an electrostatic capacity between the large-diameter and small-diameter strip rings 104 and 105, and a frequency related to the electrostatic capacity is generated. Hence, the magnetron is designed to adjust its frequency by controlling the shapes and sizes of the large-diameter and small-diameter strip rings 104 and 105, and is required to have an entirely symmetrical configuration. Generally, the change of the frequency of the magnetron changes a Q value that determines the efficiency of the magnetron, and accordingly, changes the efficiency of the magnetron.

In the conventional magnetron, the large-diameter strip ring 104 has a geographical configuration of an inside diameter of 17.2 mm, an outside diameter of 18.6 mm, a thickness of 0.7 mm and a height of 1.5 mm, while the small-diameter strip ring 105 has a geographical configuration of an inside diameter of 13.9 mm, an outside diameter of 15.35 mm, a thickness of 0.725 mm and a height of 1.5 mm. A Q value that determines the efficiency of the magnetron having such geographical configurations is about 1,850. In the past, many attempts have been made to increase the Q value without success while maintaining the oscillation frequency of the magnetron at 2450 MHz.

SUMMARY OF THE INVENTION

Accordingly, an aspect of the present invention is to provide a magnetron for use in, for example, microwave ovens, which incorporates therein a large-diameter strip ring and a small-diameter strip ring having improved geometrical configurations. The large-diameter and small-diameter strip rings of the present invention change a frequency generated in the magnetron and increase a Q value so as to improve the quality of the frequency and the efficiency of the magnetron.

Additional aspects and advantages of the invention will be set forth in part in the description which follows and, in part, will be obvious from the description, or may be learned by practice of the invention.

To achieve the above and/or other aspects of the present invention, there is provided a magnetron for microwave ovens, comprising a positive polar cylinder, a plurality of vanes which constitute a positive polar section, along with the positive polar cylinder, and a large-diameter strip ring and a small-diameter strip ring which are disposed on an upper portion and a lower portion of the vanes, respectively, and alternatively and electrically connect the vanes to one another. The large-diameter strip ring has inside and outside diameters which are in a range of 17.1 mm to 18.01 mm and 18.6 mm to 19.6 mm, respectively. The small-diameter strip ring has inside and outside diameters which are in a range of 13.4 mm to 14.4 mm and 14.9 mm to 15.9 mm, respectively. The large-diameter and small-diameter strip rings have a height which is in a range of 1.55 mm to 1.65 mm. According to an aspect of the present invention, the distance between the large-diameter and small-diameter strip rings is maintained in an error range of 2.20 mm.

BRIEF DESCRIPTION OF THE DRAWINGS

The above aspects and advantages of the present invention will become more apparent by describing in detail a preferred embodiment thereof with reference to the accompanying drawings in which.

DETAILED DESCRIPTION OF THE PREFERRED EMBODIMENTS

Figure 1:
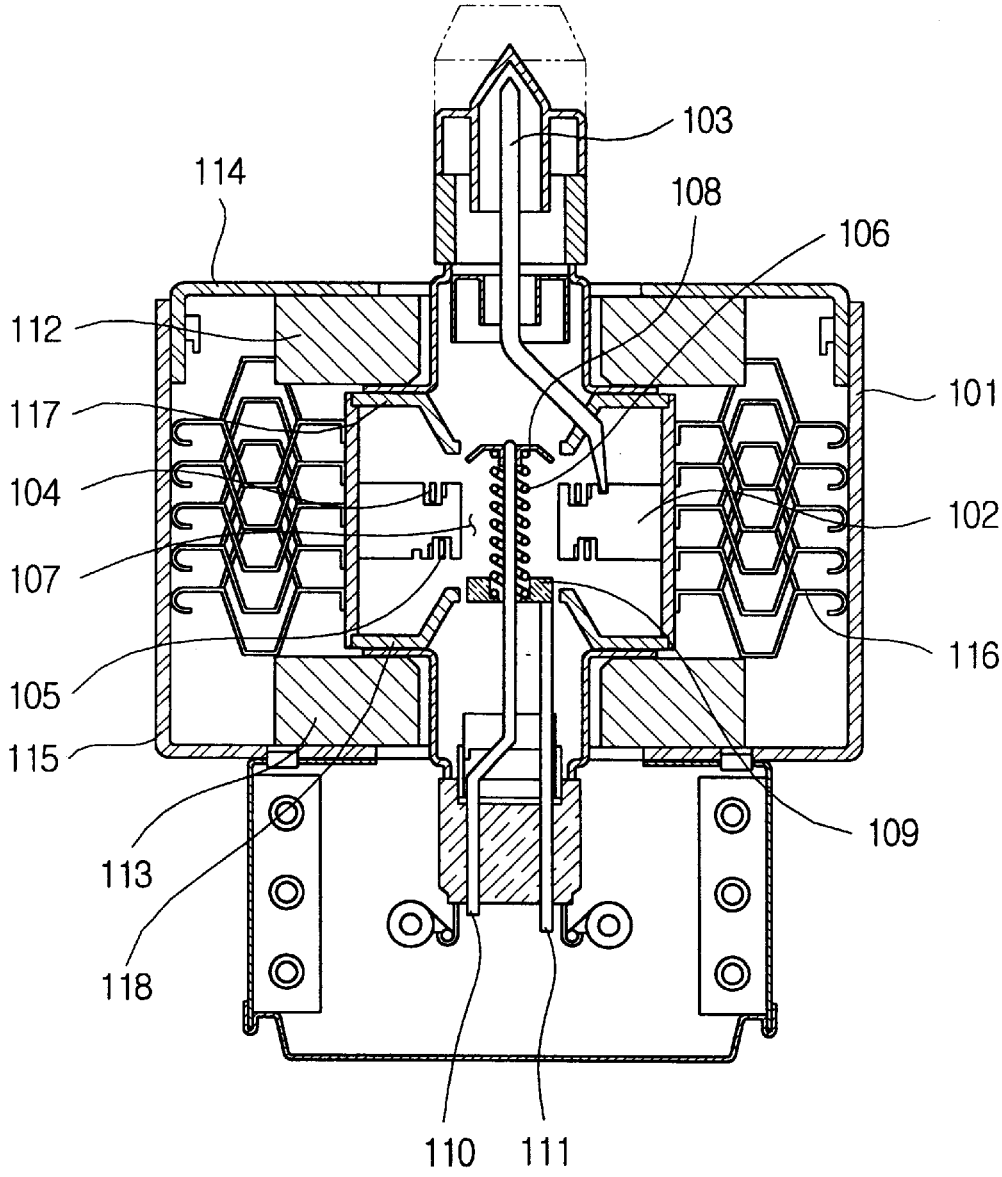
FIG. 1 is a longitudinal cross-section of a conventional magnetron for use in microwave ovens.
Figure 2:
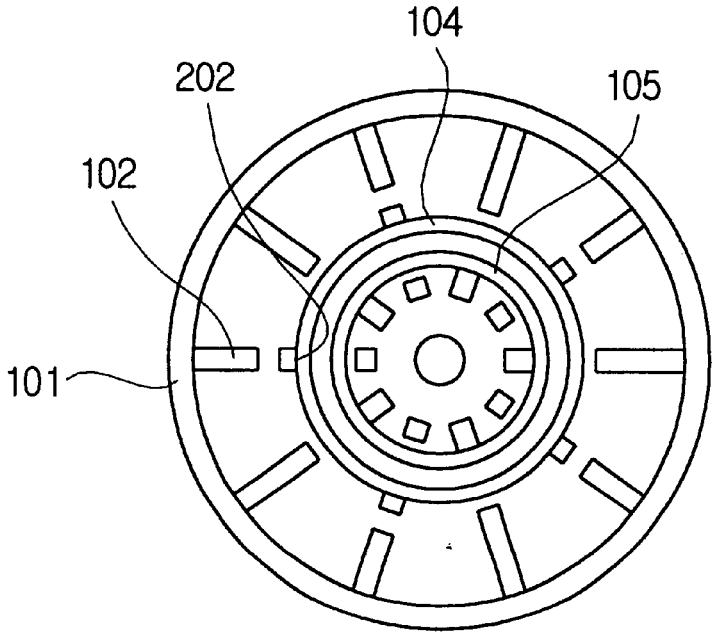
FIG. 2 (Prior Art)
FIG. 2 is a cross section of principal portions of FIG. 1.
Figure 3:
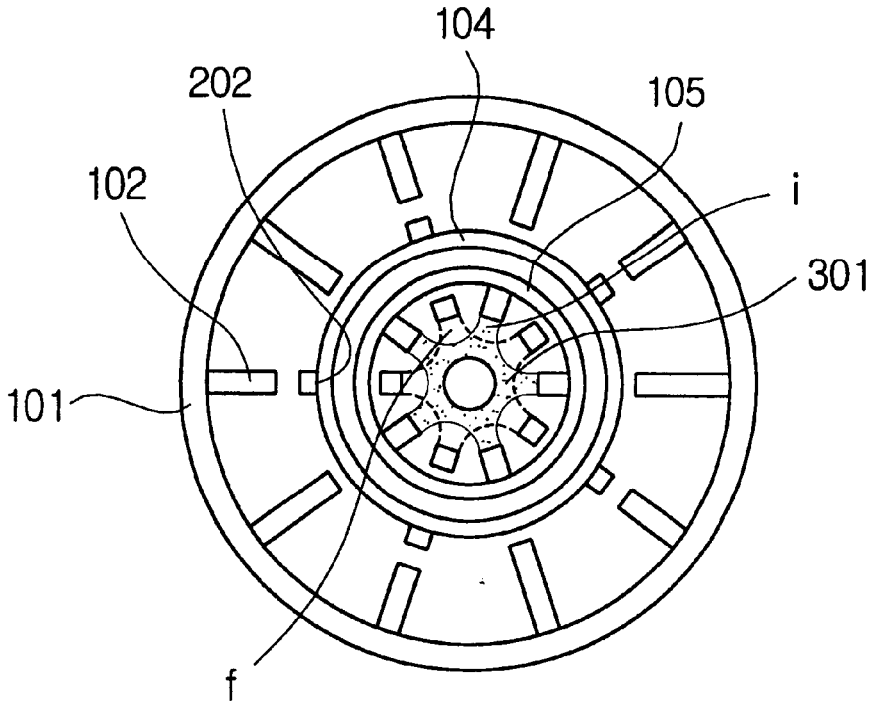
FIG. 3 (Prior Art)
FIG. 3 is a cross section illustrating the formation of thermions in FIG. 2.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 4:
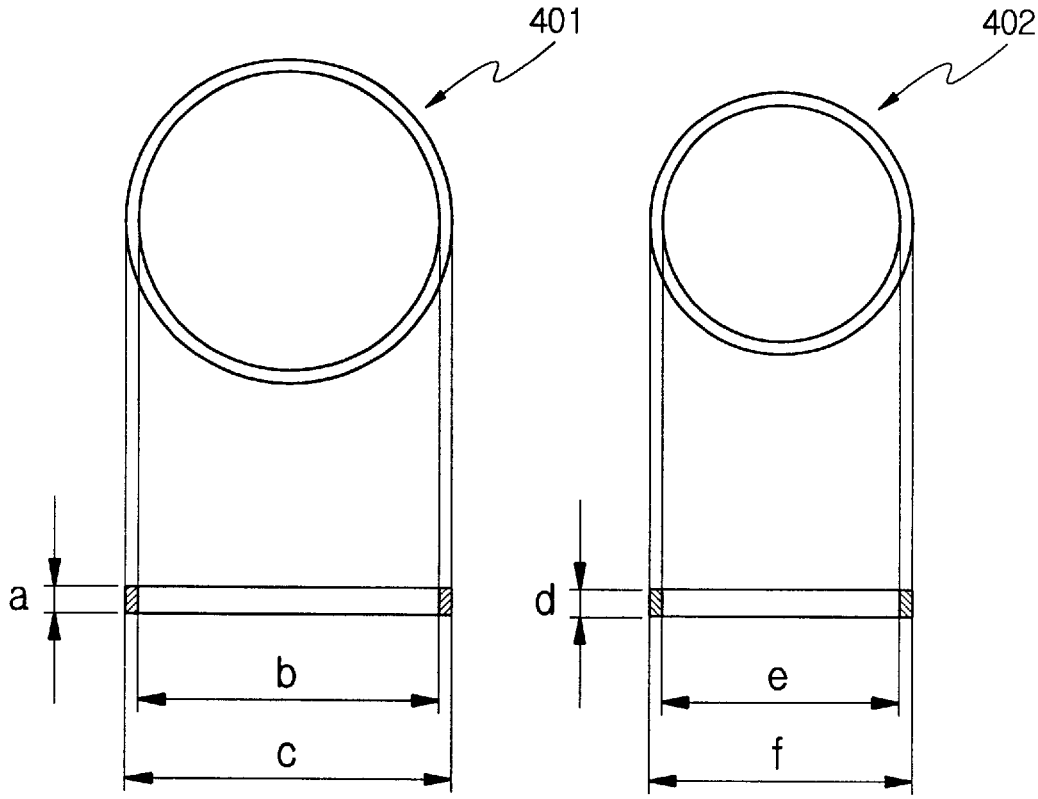
FIG. 4 is a top view of large-diameter and small-diameter strip rings for use in a magnetron according to an embodiment of the present invention.

FIG. 4 shows a large-diameter strip ring 401 and a small-diameter strip ring 402 for use in, for example, a magnetron of microwave ovens according to an embodiment of the present invention.

A reference character "a" designates the difference between upper and lower ends of the large-diameter strip ring 401, that is, a height of the large-diameter strip ring 401. A reference character "b" designates an inside diameter of the large-diameter strip ring 401, and a reference character "c" designates an outside diameter of the large-diameter strip ring 401. Additionally, the difference between the inside and outside diameters "b" and "c" of the large-diameter strip ring 401 refers to a thickness of the large-diameter strip ring 401.

Similarly to the geometrical structure of the large-diameter strip ring 401, in the small-diameter strip ring 402, a reference character "d" designates a height of the small-diameter strip ring 402, a reference character "e" designates an inside diameter of the small-diameter strip ring 402, a reference character "f" designates an outside diameter of the small-diameter strip ring 402, and the difference between the inside and outside diameters "e" and "f" of the small-diameter strip ring 402 designates a thickness of the small-diameter strip ring 402.

The numerical values, which may be assigned to the geometrical structures of the large-diameter strip ring 401 and the small-diameter strip ring 402 according to an embodiment of the present invention, are represented in the following Table 1. It is understood that the geometrical dimensions of the large and small-diameter strips rings 401 and 402 are not limited to that of Table 1. For example, the large-diameter strip ring 401 may have inside and outside diameters which are in a range of 17.1 mm to 18.01 mm and 18.6 mm to 19.6 mm, respectively. The small-diameter strip ring 402 may have inside and outside diameters which are in a range of 13.4 mm to 14.4 mm and 14.9 mm to 15.9 mm, respectively. Additionally, the large and small-diameter strip rings 401 and 402 may have a height which is in a range of 1.55 mm to 1.65 mm, or 1.50 mm to 1.60 mm.

TABLE 1

| | Inside diameter | Outside diameter | Thickness | Height |
|---|---|---|---|---|
| Large-diameter strip ring | 17.60 mm | 10.10 mm | 0.75 mm | 1.60 mm |
| Small-diameter strip ring | 13.90 mm | 15.40 mm | 0.75 mm | 1.60 mm |

As described in Table 1, the distance between the large-diameter and small-diameter strip rings 401 and 402 corresponds to the shortest distance from the inside circumference of the large-diameter strip ring 401 to the outside circumference of the small-diameter strip ring 402, that is, 2.20 mm.

An operation of the embodiment of FIG. 4 is described below. In a magnetron that is a microwave tube, a resonant frequency of a microwave generated in a positive polar cylinder significantly depends on the configuration of vanes and the configuration of the large-diameter and small-diameter strip rings 401 and 402. That is, the above-described structural configurations of a magnetron are principal factors that determine a resonant frequency of the magnetron. In other words, a frequency of a resonator is related to an electrostatic capacity, and the value of the electrostatic capacity is a constant value that is determined in relation only to geometrical configurations, such as a distance between and sizes of both conductors constituting a capacitor. Based on the above, an unloaded Q value can be obtained by the following equation 1:

$$\frac{1}{Qu} = \frac{1}{Qr\sqrt{\frac{Cr}{Ct}}} + \frac{1}{2Qs}\frac{Cs}{Ct} \tag{1}$$

where Qu is an unloaded Q value, and Qr is a unstrapped Q-factor, that is, a Q-factor in the case where no strip ring is provided.

In the above equation 1, the Qr can be obtained by the following equation 2:

$$Qr = \frac{70}{\sqrt{\lambda\pi}}\frac{Rv + Ro}{\frac{Rv}{Ro} + \frac{N}{\pi}} \tag{2}$$

In the above equation 1, Qs is a Q-factor in the case where strip rings are provided, and can be obtained by the following equation 3:

$$Qs = \frac{70ds}{\lambda\pi} \tag{3}$$

In the above-described equations 1, 2 and 3, non-described characters are as follows:

Cs: electrostatic capacity determined by strip rings,

Cr: unstrapped resonant electrostatic capacity in single resonator

Ct: electrostatic capacity of single resonator in positive polar cylinder ds: distance between large-diameter and small-diameter strip rings Ro: radius ranging from center to front end of vane Rv: inside diameter of positive polar cylinder N: number of resonators $\lambda\pi$: wavelength in $\pi$-mode As shown in the above-described equations, electrostatic capacities on the large-diameter strip ring 401 and the small-diameter strip ring 402 are proportional to a total Q-factor value, and the Q-factor is proportional to an efficiency, thus resulting in an increase in the efficiency of the magnetron. The electrostatic capacities are constant values that are determined by the geometrical configurations of the large-diameter and small-diameter strip rings 401 and 402. Accordingly, these geometrical configurations are principal factors that determine the efficiency of the magnetron. As such, where numerical values determined by the geometrical configurations of the large-diameter and small-diameter strip rings 401 and 402, in accordance with the embodiment of Table 1, are substituted for the variables of the equation 1, an unloaded Q value of about 2,000 is obtained. That is, the unloaded Q value is related to the efficiency of the magnetron, so the above-described calculation result shows that the efficiency of the magnetron is increased by incorporating the strip rings of the present invention into the magnetron.

The numerical values according to the above-described embodiment must have a certain range of error, for example, ±0.05 mm, which is a range that is allowed for the unloaded Q value. Additionally, an electrostatic capacity between the large-diameter and small-diameter strip rings 401 and 402, which is related to the unloaded Q value, is determined by the geometrical configurations of the large-diameter and small-diameter strip rings 401 and 402, such as sizes of the opposite surfaces of the large-diameter and small-diameter strip rings 401 and 402. Accordingly, a magnetron can be constructed to have an unloaded Q value of about 2,000 by not taking an exact value of 0.75 mm, but a value in the range of error and changing other factors, such as a height, and an inside diameter or an outside diameter of the large-diameter and small-diameter strip rings 401 and 402, so as to change the sizes of the opposite surfaces of the large-diameter and small-diameter strip rings 401 and 402.

It is appropriate to construct the large-diameter and small-diameter strip rings 401 and 402 to allow a distance therebetween, which determines Qs and Cs, to be 2.20 mm as described in the above-described embodiment. Although, of course, a certain range of error is allowed in the production of the strip rings, the geometrical configurations of the large-diameter and small-diameter strip rings 401 and 402 have a different range of numerical values in the case where the distance between the large-diameter and small-diameter strip rings 401 and 402 does not reach 2.20 mm within the range of an allowable error.

Additionally, although conventional large-diameter and small-diameter strip rings are constructed to merely allow their heights to be the same so as to maintain the efficiency of a conventional magnetron, large-diameter and small-diameter strip rings of the present invention are constructed to allow their heights and thicknesses to be the same, respectively, so the large-diameter and small-diameter strip rings of the present invention can have the above-described numerical values to improve the Q value of the magnetron to a value of 2,000.

As described above, the present invention provides a magnetron for use in, for example, microwave ovens, which incorporates therein a large-diameter strip ring and a small-diameter strip ring having improved geometrical configurations. The improved geometrical configurations reduce noise of a frequency generated in the magnetron, and improve the efficiency and the reliability of the magnetron.

Although a few preferred embodiments of the present invention have been shown and described, it would be appreciated by those skilled in the art that changes may be made in this embodiment without departing from the principles and sprit of the invention, the scope of which is defined in the claims and their equivalents.

What is claimed is:

1. A magnetron for microwave ovens, comprising:

a positive polar cylinder;

a plurality of vanes which constitute a positive polar section, along with the positive polar cylinder; and a large-diameter strip ring and a small-diameter strip ring which are disposed on an upper portion and a lower portion of the vanes, respectively, and alternatively and electrically connect the vanes to one another, wherein:

the large-diameter strip ring has inside and outside diameters which are in a range of 17.1 mm to 18.01 mm and 18.6 mm to 19.6 mm, respectively, the small-diameter strip ring has inside and outside diameters which are in a range of 13.4 mm to 14.4 mm and 14.9 mm to 15.9 mm, respectively, and the large-diameter and small-diameter strip rings have a height which is in a range of 1.55 mm to 1.65 mm.

2. The magnetron according to claim 1, wherein a distance between the large-diameter and small-diameter strip rings is maintained in an error range of 2.20 mm.

3. The magnetron according to claim 1, wherein the large-diameter strip ring has a difference between the inside and outside diameters of the large-diameter strip ring, which is the same as that between the inside and outside diameters of the small-diameter strip ring.

4. The magnetron according to claim 1, wherein the height of the large-diameter strip ring is the same as that of the small-diameter strip ring.

5. The magnetron according to claim 1, wherein:

the inside and outside diameters of the large-diameter strip ring are 17.6 mm and 19.1 mm, respectively, the inside and outside diameters of the small-diameter strip ring are 13.9 mm and 15.4 mm, respectively, and the height of the large-diameter and small-diameter strip rings is 1.55 mm.

6. The magnetron according to claim 1, wherein:

the vanes are arranged at regular intervals so as to form a cavity resonator, and each opposite pair of the vanes and the positive polar cylinder constitute an inductive-capacitive resonant circuit.

7. The magnetron according to claim 1, wherein the large-diameter and small-diameter strip rings alternately and electrically connect the vanes to one another so as to have the vanes alternately have the same electrical potential.

8. The magnetron according to claim 1, further comprising:

an antenna which is connected to one of the vanes and induces harmonics to the exterior of the positive polar cylinder;

a filament disposed in an axial center portion of the positive polar cylinder, wherein an activating space is provided between radial inside ends of the vanes and the filament;

top and bottom shields which are attached to corresponding end portions of the filament;

a center lead which is attached to a bottom of the top shield and passes through a through hole of the bottom shield and the filament;

a side lead attached to a bottom of the bottom shield;

upper and lower magnets which apply a magnetic field to the activating space, wherein opposite magnetic poles of the upper and lower magnets face each other;

upper and lower pole unit which induce rotating magnetic flux generated by the upper and lower magnets into the activating space;

upper and lower yokes which are provided to corresponding end portions of the positive polar cylinder; and cooling fins which connect the positive polar cylinder to the lower yoke and radiate heat generated in the positive polar cylinder to the exterior of the positive polar cylinder.

9. The magnetron according to claim 1, wherein the magnetron has an unloaded Q value of about 2,000.

10. The magnetron according to claim 1, wherein the large-diameter and small-diameter strip rings have the same height and thickness so as to reduce noise of a frequency generated in the magnetron and improve an unloaded Q value of the magnetron.

11. A magnetron for use in apparatuses utilizing a microwave, comprising:

a positive polar cylinder;

a plurality of vanes, along with the positive polar cylinder, which define a positive polar section; and a large-diameter strip ring and a small-diameter strip ring which are disposed on an upper portion and a lower portion of the vanes, respectively, and alternatively and electrically connect the vanes to one another, wherein:

the large-diameter strip ring has inside and outside diameters which are in a range of 17.1 mm to 18.01 mm and 18.6 mm to 19.6 mm, respectively, the small-diameter strip ring has inside and outside diameters which are in a range of 13.4 mm to 14.4 mm and 14.9 mm to 15.9 mm, respectively, and the large-diameter and small-diameter strip rings have a height which is in a range of 1.50 mm to 1.60 mm and the same thicknesses.

12. The magnetron according to claim 11, wherein the height of the large-diameter strip ring is the same as that of the small-diameter strip ring.

13. A magnetron for use in apparatuses utilizing a microwave, comprising:

a positive polar cylinder;

a plurality of vanes, along with the positive polar cylinder, which define a positive polar section; and a large-diameter strip ring and a small-diameter strip ring which are disposed on an upper portion and a lower portion of the vanes, respectively, and alternatively and electrically connect the vanes to one another, wherein:

the large-diameter strip ring has inside and outside diameters which are in a range of 17.1 mm to 18.01 mm and 18.6 mm to 19.6 mm, respectively, the small-diameter strip ring has inside and outside diameters which are in a range of 13.4 mm to 14.4 mm and 14.9 mm to 15.9 mm, respectively, and the large-diameter and small-diameter strip rings have a height which is in a range of 1.50 mm to 1.60 mm, and are capable of producing an unloaded Q value of more than 1,850 so as to improve a frequency and an efficiency of the magnetron.

14. The magnetron according to claim 11, wherein the inside diameter of the large-diameter strip ring and the outside diameter of the small-diameter strip ring have a difference which is maintained in an error range of 2.20 mm.

15. The magnetron according to claim 11, wherein the magnetron has an unloaded Q value of about 2,000.

16. The magnetron according to claim 11, wherein the magnetron has an unloaded Q value of about 2,000.

17. The magnetron according to claim 11, wherein:

the inside and outside diameters of the large-diameter strip ring are 17.6 mm and 19.1 mm, respectively, the inside and outside diameters of the small-diameter strip ring are 13.9 mm and 15.4 mm, respectively, and the height of the large-diameter and small-diameter strip rings is 1.55 mm.

18. The magnetron according to claim 13, wherein the magnetron has the unloaded Q value of about 2,000.

19. The magnetron according to claim 13, wherein the large-diameter and small-diameter strip rings have the same heights.

20. The magnetron according to claim 13, wherein the large-diameter and small-diameter strip rings have the same thicknesses.

21. The magnetron according to claim 13, wherein the inside diameter of the large-diameter strip ring and the outside diameter of the small-diameter strip ring have a difference which is maintained in an error range of 2.20 mm.

22. The magnetron according to claim 13, wherein:

the inside and outside diameters of the large-diameter strip ring are 17.6 mm and 19.1 mm, respectively, the inside and outside diameters of the small-diameter strip ring are 13.9 mm and 15.4 mm, respectively, and the height of the large-diameter and small-diameter strip rings is 1.55 mm.

23. A magnetron for use in apparatuses utilizing a microwave, comprising:

a positive polar cylinder;

a plurality of vanes, along with the positive polar cylinder, which define a positive polar section; and a large-diameter strip ring and a small-diameter strip ring which are disposed on an upper portion and a lower portion of the vanes, respectively, and alternatively and electrically connect the vanes to one another, wherein the large-diameter and small-diameter strip rings have the same height and thickness so as to improve a frequency and an efficiency of the magnetron, wherein the magnetron has an unloaded Q value of about 2,000.

* * * * *